United States Patent [19]

Albrecht et al.

[11] 4,227,617

[45] Oct. 14, 1980

[54] CONTAINER CLOSURE

[75] Inventors: Leman P. Albrecht, Richmond; W. Coy Willis, Hagerstown, both of Ind.

[73] Assignee: Aluminum Company of America, Pittsburgh, Pa.

[21] Appl. No.: 71,318

[22] Filed: Aug. 30, 1979

[51] Int. Cl.[3] ..... B65D 41/40

[52] U.S. Cl. ..... 215/251; 215/249; 215/255

[58] Field of Search ..... 215/249, 251, 255

[56] References Cited

U.S. PATENT DOCUMENTS

| | | | |
|---|---|---|---|
| 2,465,269 | 3/1949 | Rohde et al. . | |
| 3,071,274 | 1/1963 | Ravn | 215/249 |
| 3,193,128 | 7/1965 | Raun . | |
| 3,358,865 | 12/1967 | Andersen . | |
| 3,587,897 | 6/1971 | Rohde . | |
| 3,612,340 | 10/1971 | Heffran | 215/255 |
| 3,750,820 | 8/1973 | Labarre . | |
| 3,888,377 | 6/1975 | Stadler . | |

*Primary Examiner*—Donald F. Norton
*Attorney, Agent, or Firm*—Patrick J. Viccaro

[57] ABSTRACT

A container closure assembly for maintaining a sterile sealed container is provided having a ferrule having a top annular portion and a depending skirt portion for securing a resilient stopper for sealing the mouth of a container to the container, and a ring fitment for opening the closure assembly overlying and interlocking with the ferrule. The ferrule includes a central opening in the top annular portion, upwardly projecting locking portions about the periphery of the opening and a weakening line radially outwardly of and concentric with the locking portions. The fitment includes a disk portion and a concentric outer lifting ring hingedly connected to the inner disk portion for opening the closure assembly. The disk portion is secured within the opening of the top portion of the ferrule by the locking projections.

7 Claims, 5 Drawing Figures

FIG. 1.
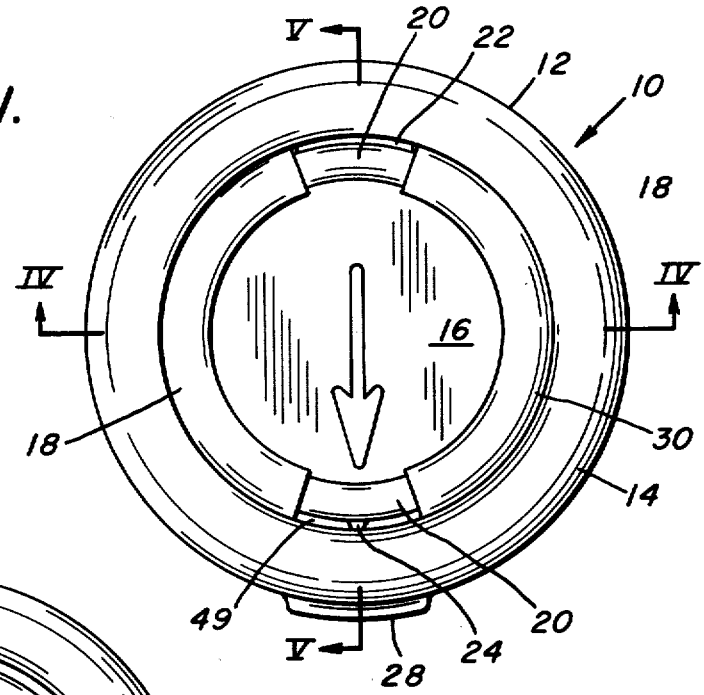
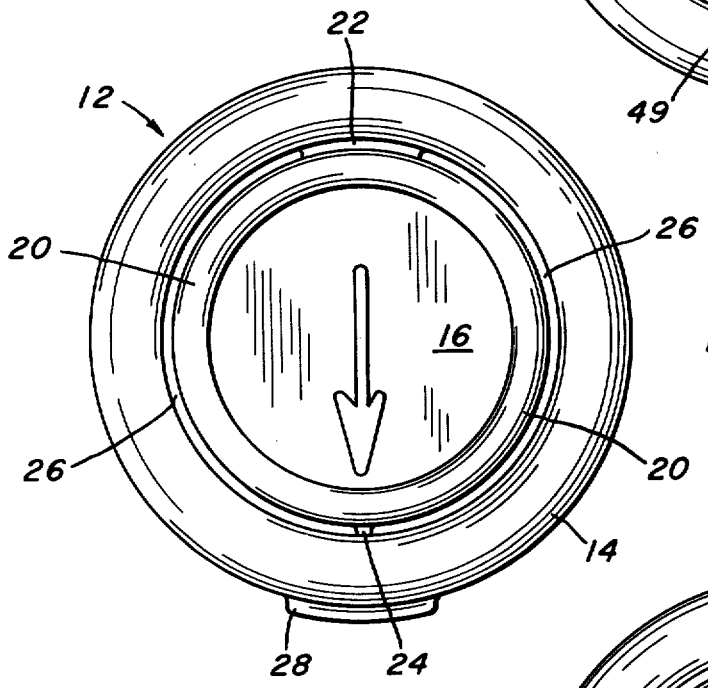
FIG. 2.
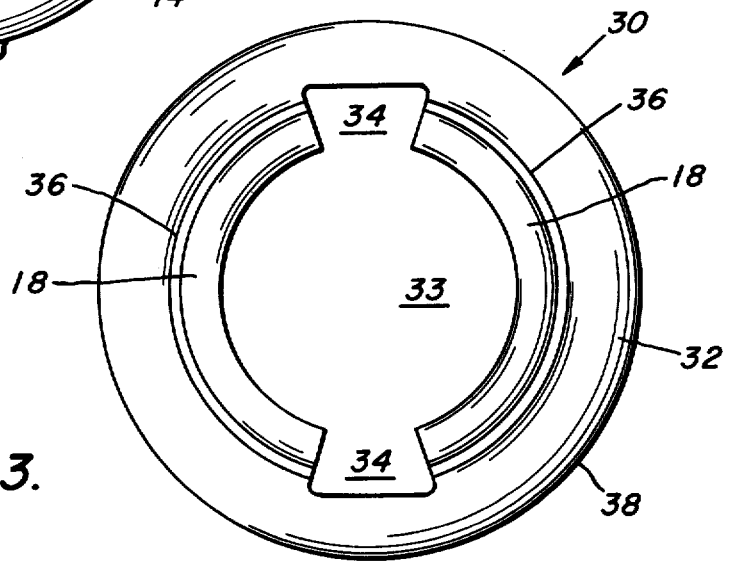
FIG. 3.

CONTAINER CLOSURE

BACKGROUND OF THE INVENTION

This invention relates to a multipiece closure for use with sterile containers. More particularly, the invention relates to a retortable composite closure assembly having an outer ring pull for easy opening of sterile containers for pharmaceuticals and the like.

Generally, closures for containers useful in the packaging of pharmaceuticals and the like must be able to maintain an internal sterile condition in order to provide a safe and contamination-free product. The structure and materials of the closure assemblies must be able to withstand sterilization conditions. A retortable closure must also be easy to open and yet be tamperproof to avoid inadvertent opening and to warn of previous opening.

Numerous attempts to satisfy all of the above conditions and provide a convenient and safe closure have not been met with complete success. It is known to provide access to a pierceable closure stopper, of rubber or like material, which is held in place by a metallic cap by having a removable disk portion. U.S. Pat. No. 2,465,269, issued Mar. 22, 1949, provides a central removal disk severed from the cap along arcuate lines but integrally connected to the annular top portion of the cap by frangible ribs. Such a closure is not only difficult to open for the user must pry off the removable disk, but the severance line on the closure provides a source of contamination to the underlying stopper.

It is also known to provide a cover member connected to such an inner removable disk portion which is detachable by fracturable bridge members. The disk includes an opening through which an extension of the cover member protrudes downwardly to engage within the opening to secure the cover member on the disk portion of the outer shell. Opening of the closure is accomplished by pushing upwardly, such as by the user's thumb, against outer portions of the cover which project outwardly beyond the outer edges of the cap as is disclosed in U.S. Pat. No. 3,071,274, issued Jan. 1, 1963.

Variations in the above-described structure for a cover member connected to a removable disk portion are also known. U.S. Pat. No. 3,193,128, issued July 6, 1965, discloses making the extension of the cover member from a reformed hard plastic which is fracturable, thus eliminating the need for a removable disk portion in the metal shell. Another closure assembly includes a score line defining the removable disk portion of the metal shell instead of fracturable connecting bridges and is shown in U.S. Pat. No. 3,587,897, issued June 28, 1971. Reformed plastic is also mentioned in that patent for attaching the cover member to the removable disk.

Still another variation is shown in U.S. Pat. No. 3,358,865, issued Dec. 19, 1967, which includes an upwardly projecting button located on a disk portion of the shell which is removable by breaking frangible bridge members. The button extends through an opening in the cover member and engages over the body portion of the cover to hold the cover in the shell in a locked condition.

It is also known in the art to use ring pull features for opening containers. Though not suitable for sterilized containers, U.S. Pat. No. 3,612,340, issued Oct. 12, 1971, shows a container closure using a metal cap with a tear tab and a sealing liner. The cap has a tear tab secured to an integral rivet part of a raised removable panel which is defined by a score line and is removable when the tab is pulled. It is also known that a stopper may be provided with a gripping ring which is accommodated by an annular space formed around the circular body of a stopper as is shown in U.S. Pat. No. 3,750,820, issued Aug. 7, 1973. A closure cap for providing a sterile seal may also include a cap having a depending skirt and end wall portion having a tear-off cover portion integrally formed in the end wall. The tear-off portion, defined by a weakening groove, is removed by a ring pull integrally formed with the tear-off portion and is shown in U.S. Pat. No. 3,888,377, issued June 10, 1975.

Such prior known closures for providing sterile packaging are not without problems. The lancing in some container closures is a potential source of contamination to the stopper. Furthermore, when using reformed plastic for forming the closure assemblies, there is difficulty in the manufacturing operations in order to control the tearing or breaking of the closure assembly in a desirable manner. Furthermore, the closure assembly may not be a sealed assembly such as when a reformed hard plastic plug is inserted into a hole in a closure cap. Subsequent sterilization of a closure assembly may also adversely affect the closure integrity. Another problem associated with the closures having an overcap is that they are not easy to open. In order to make the closures easy to open with the push of a thumb, the manufacturing tolerances of any fracturable bridges and scoring must be carefully controlled. There exists a need, therefore, for a retortable closure assembly which maintains an internal sterile condition but which is easier to open than prior known closures.

SUMMARY OF THE INVENTION

In accordance with the present invention, a closure assembly is provided which is convenient and safe to open. A closure assembly comprises a ferrule having a top annular portion and a depending skirt portion for securing a sealing member to the container, and a fitment overlying and interlocking with the ferrule. The top portion of the ferrule has upwardly projecting locking portions about a central opening and a weakening line radially outwardly of and concentric with the locking portions. The fitment includes a disk portion and an outer concentric ring hingedly connected to the inner disk portion. The disk portion is secured within the opening of the top portion of the ferrule by the locking projections and the ring lies radially outwardly of the disk and locking portions. The closure is opened by lifting the concentric outer ring of the fitment at a location diametrically opposite the hinge such that the ring flexes at the hinged area resulting in a downward force on the top portion of the ferrule and an upward force on the locking projections such as to fracture the weakening lines of the closure assembly. Further lifting of the ring causes the disk portion of the fitment and the locking projections of the ferrule to be removed exposing the sterile sealing member. The closure assembly may also include a resilient member for sealing the container mouth and which has upward annular sealing projections.

As was an object of the present invention, a closure assembly is provided which is easy to open and which is suitable for both small and large mouthed containers. The closure assembly also can be made tamperproof by the addition of one or more frangible bridges connecting the disk portion with the outer concentric ring portion. Furthermore, such a closure assembly is easier to manufacture for the mechanical advantage available by the ring pull feature allows the manufacturing tolerances of the score lines and fracturable bridges to be less critical.

BRIEF DESCRIPTION OF THE DRAWINGS

FIG. 1 is a top view of the closure assembly of the present invention.

FIG. 2 is a plan view of the pull ring fitment of the present invention.

FIG. 3 is a plan view of the ferrule member of the present invention.

DETAILED DESCRIPTION OF THE PREFERRED EMBODIMENTS

Figure 4:
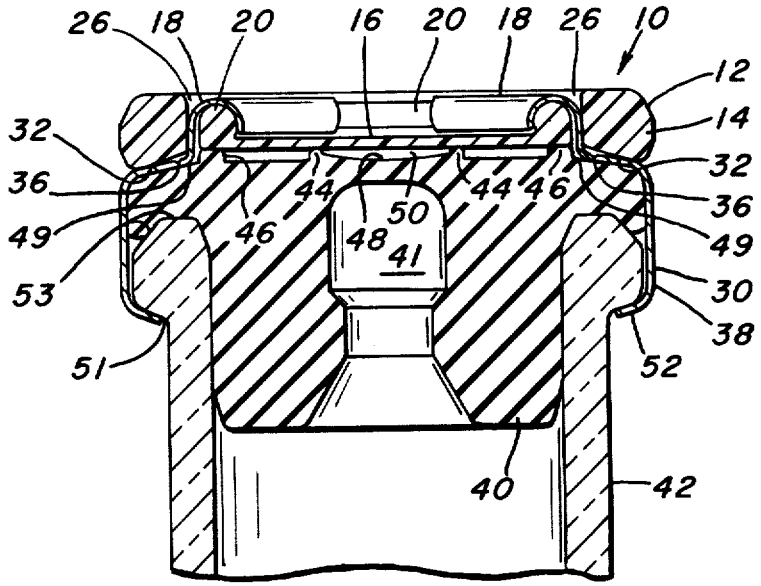
FIG. 4 is an elevation cross section of the closure assembly taken along line IV—IV of FIG. 1.

FIG. 1 is a top view of closure assembly 10 of the present invention which includes a ring fitment 12 engaged within upward locking projections 18 of a cap or ferrule 30. Ring fitment 12 includes a disk portion 16 and a concentric outer ring portion 14 flexibly joined by a hinge 22 and frangibly joined by bridge 24. Disk portion 16 includes arcuate ribs 20 on the outer periphery disk portion which are lockingly engaged with locking projections 18 of ferrule 30. The closure assembly is opened by lifting outer concentric ring 14 such as to fracture bridge member 24 and cause flexing at hinge 22. Further lifting causes separation of the removable locking projections 18 from ferrule 30 along weakening lines (not visible in this view) underlying outer ring 14 to provide access to a sterile container.

FIG. 2 is a plan view of the ring fitment 12 showing the features thereof in more detail. Disk 16 is substantially circular and planar. As shown in FIG. 2, in the preferred embodiment, disk 16 includes arcuate rib 20 projecting upwardly about the periphery of disk 16. As used herein, upward means in the direction above a container having closure assembly 10 thereon, and downward means in the opposite direction. Ribs 20 may be continuous, as shown in FIG. 2, and extend around the entire periphery of disk 16, or ribs 20 may be discontinuous and discrete ridges selectively located about the periphery of disk portion 16. In the alternative, slots or detents in disk 16 may be used instead of projecting ribs. Disk 16 may be of a variety of diameters such as may be necessary to accommodate both relatively small and large-mouthed containers.

Generally, outer ring 14 is located concentrically about the periphery of disk portion 16 and is spaced apart therefrom. Ring 14 is connected to disk 16 by flexible hinge 22 and may also be connected by frangible bridge 24. Preferably, ring 14 and disk 16 are joined by at least one frangible bridge member 24, preferably, located diametrically opposed to hinge 22. Outer ring 14 may include a lifting finger 28 projecting outwardly from the outer periphery of ring 14 and diametrically opposite hinge 22 and adjacent frangible bridge 24. Lifting finger 28 facilitates lifting of outer ring 14 during opening of the closure by the user, as well as providing a means of orientation during assembly of ferrule 30 and ring fitment 12.

Ring fitment 12 may be made of any of a variety of materials. It is preferred, however, that fitment 12 be made of a hard plastic material which can be easily manufactured and which can more readily seal and maintain the sterile area of a container mouth. Polypropylene is a preferred material.

FIG. 3 is a plan view of cap or ferrule 30 of a closure assembly 10. Ferrule 30 includes a top annular portion 32 and a depending skirt portion 38 (not visible in this view) and a central opening 33 defined by annular portion 32. About the periphery of central opening 33 are upward locking projections 18 which extend substantially around the periphery of opening 33. At least one locking projection 18 is required. Preferably, two substantially identical arcuately extending locking projections are provided diametrically opposite to one another. In the alternative, projections 18 may be a plurality of discrete locking extensions for engagement with discrete ridges of disk 16. Preferably, locking projections 18 have an upper section curled radially inwardly and downwardly (as best shown in a completed closure assembly 10 of FIG. 4). Though FIG. 3 shows projections 18 in their curled configuration after assembly, locking projections 18 prior to assembly with fitment 12 are vertically upwardly extending planar members lying along an arcuate path radially inwardly from weakening line 36.

FIG. 3 shows two locking projections 18 extending along an arcuate path about the periphery of opening 33 and separated by two access openings 34 shown diametrically opposite one another. A plurality of access openings 34 may be provided. Each opening 34 is an extension of and continuous with central opening 33 and defined as a region where terminal ends of locking projections 18 are spaced apart. Openings 34 are provided for permitting fitment 12 to cooperate with ferrule 30 to provide access to hinge 22 and bridge 24 for the function of opening closure assembly 10 which will be further explained later. At least one access opening 34 is required for alignment with hinge 22 of fitment 12.

A weakening line 36, preferably a score line, is shown located radially outwardly of and concentric with the upward locking projections 18. Weakening line 36 defines an enclosed area which is removable. In FIG. 3, two arcuate sections of line 36 are shown intersecting with access openings 34 to define a removable sector of ferrule 30 for the purpose of permitting separation of arcuate locking projections 18 from ferrule 30 during opening of closure assembly 10. In the alternative, all cutout access openings 34 may be located within the removable sector defined by weakening line 36 and not intersected by weakening line 36. Preferably, two access openings 34 are provided. One opening 34 for alignment with hinge 22 of fitment 12 is intersected by weakening line 36, and the second opening 34 for alignment with frangible bridge 24 of fitment 12 is located within the removable sector.

Ferrule 30 can be made of various material compositions. Preferably, ferrule 30 is of a metallic material such as aluminum having the strength and formability for maintaining its shape and for sealing a resilient member in the mouth of a container as is shown in FIG. 4.

FIG. 4 is an elevation cross section taken along line IV—IV of the closure assembly of the present invention in FIG. 1. Closure assembly 10 is shown securing a resilient sealing member or stopper 40 in the mouth of a container 42, such as a bottle. In a conventional manner, depending skirt 38 of ferrule 30 is secured about shoulder portion 51 of the container mouth by inwardly bent ends 52 of depending skirt 38. Stopper 40 is secured in the mouth of the container such that there is sealing contact between the stopper and the top surfaces 53 of the container mouth. Stopper 40 may also include a hollow area 41 centrally located in the stopper and opening downwardly into the bottle area as is conventionally known.

Closure assembly 10 is shown with ring fitment 12 in an overlying and contacting engagement with ferrule 30. In an assembled condition outer ring 14 overlies and contacts top annular portion 32 of ferrule 30. Locking projections 18 are shown to extend upwardly through space 26 between outer ring 14 and disk portion 16 of fitment 12. Locking projections 18 are also shown curled radially inwardly and downwardly, so as to be tucked inwardly and locked about arcuate ribs 20 of disk portion 16 of fitment 12. Disk 16 is held within opening 33 of ferrule 30. Weakening line 36 which is concentrically and radially outwardly from locking projections 18 underlies a portion of outer lifting ring 14 of fitment 12. The locking engagement of ferrule 30 with fitment 12 secures disk 16 against top portion 48 of stopper 40. Though the lower surface of disk 16 may directly contact surface 48 of stopper 40, preferably, inner and outer annular sealing projections 44 and 46, respectively, may be provided for contact. Inner and outer annular projections each follow a closed annular path on the top surface 48 of stopper 40 and extend upwardly from sterile top surface 48 of stopper 40 such that there is a space 50 between the top surface 48 of stopper 40 and the lower surface of disk portion 16. While at least an inner annular projection 44 is preferred, it is most preferred that an outer annular projection 46 be placed concentrically outwardly from inner annular projections 44 for a double seal. Such projections permit sealing of the stopper against the disk to maintain areas of sterile conditions on the stopper top surface 48. As is shown in FIG. 1, a portion of stopper 40 may be visible or accessible from outside the closure assembly. Surface 49 is accessible radially outwardly of annular projections 44 and 46.

Figure 5:
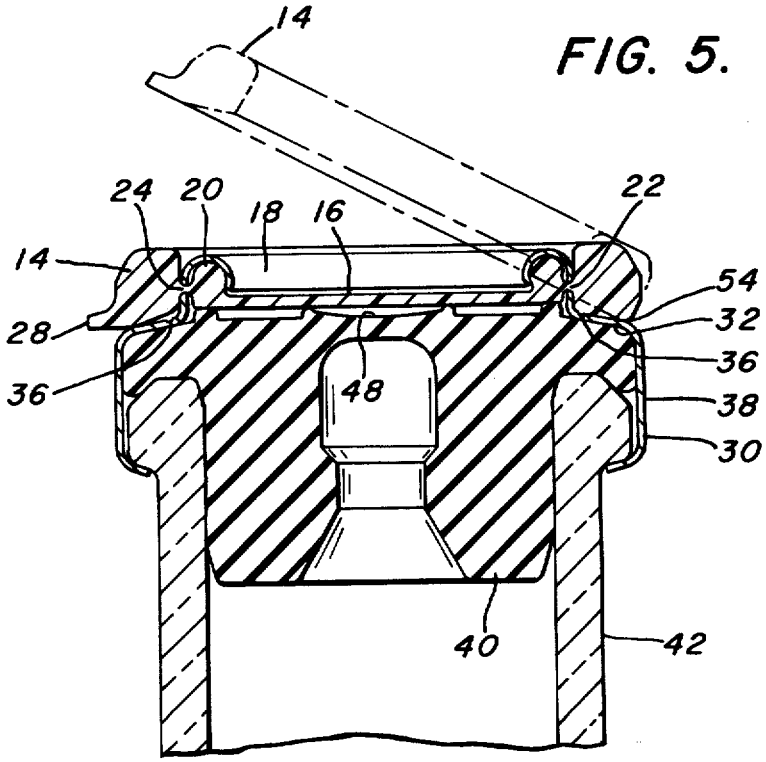
FIG. 5 is an elevation cross section of the closure assembly taken along line V—V of FIG. 1.

FIG. 5 is an elevation cross sectional view taken along line V—V of FIG. 1 showing a preferred embodiment of closure assembly 10 of the present invention. FIG. 5 is substantially the same as the cross sectional view of FIG. 4 except that frangible bridge 24 and flexible hinge 22 are illustrated. Fracturable bridge 24 connects outer ring 14 and disk 16 at arcuate rib 20. Diametrically opposed to fracturable bridge 24 is hinge 22 which also connects between outer ring 14 and arcuate rib 20 of disk 16.

For opening of closure 10 shown in FIG. 5, an upward force exerted against lifting finger 28 of outer ring 14, such as by a thumb or finger of the user, causes frangible bridge 24 to fracture. Outer ring 14 thus becomes free from inner disk portion 16 except as it is connected to disk 16 by hinge 22. If more than one frangible bridge interconnects outer ring 14 and disk 16, as the outer ring is continually lifted by an upward force, any additional frangible bridges will fracture. As outer ring 14 is lifted (as shown by the broken lines) and is flexed about hinge 22, the pivotal action about hinge 22 causes the lower portion of ring 14 to exert a downward force on top annular portion 32 of ferrule 30 and an upward force on locking projections 18 in an area adjacent weakening line 36. Camming area 54 on top annular portion 32 creates an upward force on the inner periphery of ring 14 which is transmitted through hinge 22 as an upward force and movement of arcuate rib 20 and disk 16. Such movement pushes upwardly against locking projections 18 of ferrule 30 resulting in a rupture of weakening line 36 adjacent camming area 54. Further upward movement of outer ring 14 results in rupturing of the entire weakening line 36 and removal of locking projections 18 from ferrule 30 and disk 16 of fitment 12 which is interlocked with projections 18. Removal of disk 16 exposes sterile top surface 48 of stopper 40. The sterile container can now be used in a conventional manner without the need for sterilizing top surface 48 such as by swabbing with an antiseptic.

The ring system of the present invention utilizes a long lever arm about equal to the diameter of ring 14 and a short resistance arm about equal to the distance from the hinge to the camming area on the lower surface of ring 14 and results in a mechanical advantage greater than provided by the designs of prior art closures. Such a mechanical advantage provides the capability for removal of more and stronger closure material to provide a larger access hole to the sterile sealing stopper. Furthermore, because of the added leverage attributed to the ring system of the present invention, manufacturing tolerances are less critical thus resulting in lower manufacturing costs. As the added leverage can tear or fracture stronger and thicker members, such as score line residuals and frangible bridges, the dimensional tolerances for such features are less critical.

Although preferred embodiments of a closure assembly of the present invention have been illustrated and described, it will be apparent to those skilled in the art that numerous changes and variations can be made therein without departing from the scope of invention.

What is claimed is:

1. A closure assembly comprising:

a ferrule having a top annular portion and a skirt portion depending from the outer periphery of the top portion for securing said closure to a container, said top portion having at least one upwardly projecting locking portion on the periphery of a central opening defined by said top annular portion, and a weakening line radially outwardly of said locking portion and concentric with the central opening; and a fitment overlyingly contacting and interlocking with said ferrule, said fitment including a disk portion which is secured within the central opening of said top portion of said ferrule by said locking projection, and a concentric outer lifting ring hingedly connected to said inner disk portion.

2. The closure assembly as set forth in claim 1 further including a resilient member for sealing the mouth of a container.

3. The closure assembly as set forth in claim 2 wherein said resilient member includes an annular sealing projection upwardly extending from the top surface of said resilient member.

4. The closure assembly as set forth in claim 1 wherein said ferrule includes at least one locking projection arcuately extending about the periphery of the central opening of said top annular portion with adjacent locking projection terminal ends spaced apart in a first region where said disk portion of said ferrule is hingedly connected to said outer lifting ring.

5. The closure assembly as set forth in claim 4 further including adjacent locking projection terminal ends spaced apart in a second region.

6. The closure assembly as set forth in claim 5 further including a frangible member connecting said outer lifting ring and said disk portion of said fitment in the second region.

7. A composite closure assembly comprising:

a stopper for sealing the mouth of a bottle and having inner and outer annular sealing projections upwardly extending from the top surface of the stopper;

a metal ferrule having a top annular portion and a skirt portion depending from the outer periphery of the top portion for engaging a shoulder about the bottle mouth for securing the stopper, said top annular portion defining a central opening in said ferrule and having at least one arcuate upward locking projection about the periphery of the opening, said locking projection having a downwardly oriented curled upper section, and said top portion having adjacent locking projection terminal ends spaced apart in a region defining an access opening continuous with the central opening of said top annular portion and having a weakening line radially outwardly of said locking projection and concentric with the central opening to define a removable sector; and a plastic fitment including a disk portion having an arcuate rib about its top periphery in locking engagement with the curled section of the locking projection of said ferrule for securing said disk portion within the opening of said top annular portion of said ferrule and in overlying and sealing contact with the annular sealing projections of said stopper, and said fitment including an outer lifting ring concentric with said disk portion and hingedly connected to said disk portion in a region adjacent the access opening and the weakening line of said top annular portion of said ferrule.

* * * * *